United States Patent [19]

Yuzawa

[11] 4,097,563

[45] Jun. 27, 1978

[54] ALTITUDE CORRECTION DEVICE OF A CARBURETOR

[75] Inventor: Haruo Yuzawa, Tokyo, Japan

[73] Assignee: Nissan Motor Company, Limited, Japan

[21] Appl. No.: 647,555

[22] Filed: Jan. 8, 1976

[30] Foreign Application Priority Data

Jan. 14, 1975 Japan ..... 50-6637

[51] Int. Cl.[2] ..... F02M 7/24

[52] U.S. Cl. ..... 261/121 B; 55/422

[58] Field of Search ..... 261/121 B; 55/422, 328

[56] References Cited

U.S. PATENT DOCUMENTS

| | | | |
|---|---|---|---|
| 1,792,824 | 2/1931 | Dearborn | 55/422 |
| 2,208,317 | 7/1940 | Beck | 261/121 B |
| 2,349,676 | 5/1944 | Pratt | 261/121 B |
| 3,425,672 | 2/1969 | Seigel et al. | 261/121 B |
| 3,899,551 | 8/1975 | Korte | 261/121 B |
| 3,933,951 | 1/1976 | Fischer et al. | 261/121 B |

*Primary Examiner*—Tim R. Miles

*Attorney, Agent, or Firm*—Robert E. Burns; Emmanuel J. Lobato; Bruce L. Adams

[57] ABSTRACT

An altitude correction device is constructed to manually open and close a supplementary air bleed to the atmosphere which bleed communicates with a fuel passage of a carburetor, in accordance with changes in the altitude.

3 Claims, 11 Drawing Figures

ALTITUDE CORRECTION DEVICE OF A CARBURETOR

BACKGROUND OF THE INVENTION

The present invention relates generally to an altitude correction device, of a carburetor for correcting changes in an air-fuel ratio owing to changes in the atmospheric pressure and particularly to an altitude correction device of this type which comprises means to manually open and close a supplementary air bleed to the atmosphere, communicating with a fuel passage of a carburetor, in accordance with changes in the altitude of the engine running land.

Usually, since, when the altitude increases, the atmospheric pressure decreases to decrease the density of air, a carburetor provides an enriched air-fuel mixture having an air-fuel ratio lower than a set air-fuel ratio. This results in a decrease in fuel economy and increases in the concentrations of air pollutants in engine exhaust gases. Thus, a carburetor is provided with an altitude correction device for preventing enrichment of an air-fuel mixture due to decreases in the atmospheric pressure to maintain the air-fuel ratio of the air-fuel mixture constant or in the set air-fuel ratio independently of changes in the atmospheric pressure by admitting supplementary air into a fuel passage of the carburetor in accordance with decreases in the atmospheric pressure.

A conventional altitude correction device has been constructed such that an atmospheric pressure responsive bellows extends and compresses in response to changes in the atmospheric pressure to cause a control valve to operate to control the amount of supplementary air admitted into a supplementary air bleed communicating with a fuel passage of a carburetor to correct enrichment of an air-fuel mixture, provided by the carburetor, due to increases in the altitude.

However, the conventional altitude correction device has had a drawback that the bellows extends and compresses in response to vibrations acting on the device caused by engine operations and/or motor vehicle running to cause the control valve to operate. Accordingly, when the vibrations are exerted on the altitude correction device during correcting a decrease in an air-fuel ratio due to an increase in the altitude, the opening of the control valve is varied or deviated from a predetermined or desired value so that excessive or deficient supplementary air is admitted into the supplementary air bleed to make it impossible to correct the air-fuel ratio of an air-fuel mixture enriched because of an increase in the altitude to the set or desired air-fuel ratio. Furthermore, when the vibrations take place during running of the engine on a relatively low land which does not cause a decrease in an air-fuel ratio, the control valve is opened by axial movement of the bellows by the vibrations so that unnecessary supplementary air is admitted into the fuel passage to cause an undesired increase in the air-fuel ratio of the air-fuel mixture provided by the carburetor.

In order to prevent the conventional altitude correction device from being affected by the vibrations to feed excessive or insufficient or unnecessary supplementary air into the fuel passage, it has been proposed to set the force of the biasing means, urging the bellows and the control valve, to an appropriate value or provide the altitude correction device with a vibration resistant mechanism. However, these solutions have merely rendered the construction of the altitude correction device complex and caused an increase in the production cost of the device and have been unable to prevent the device from being affected by vibrations. Furthermore, since the conventional altitude correction device is automatic, it has been ready to meet with troubles and has been short of reliability and certainty.

SUMMARY OF THE INVENTION

It is, therefore, an object of the invention to provide an altitude correction device which comprises means for manually opening and closing a supplementary air bleed to the atmosphere, communicating with a fuel passage of a carburetor, in accordance with changes in the altitude so that the correction of a decrease in an air-fuel ratio due to an increase in the altitude is sufficiently accomplished and the device is prevented from being affected by vibrations to admit excessive or insufficient or unnecessary supplementary air into the fuel passage.

BRIEF DESCRIPTION OF THE DRAWINGS

This and other objects and advantages of the invention will become more apparent from the following detailed description taken in connection with the accompanying drawings in which.

DESCRIPTION OF THE PREFERRED EMBODIMENTS

Figure 1:
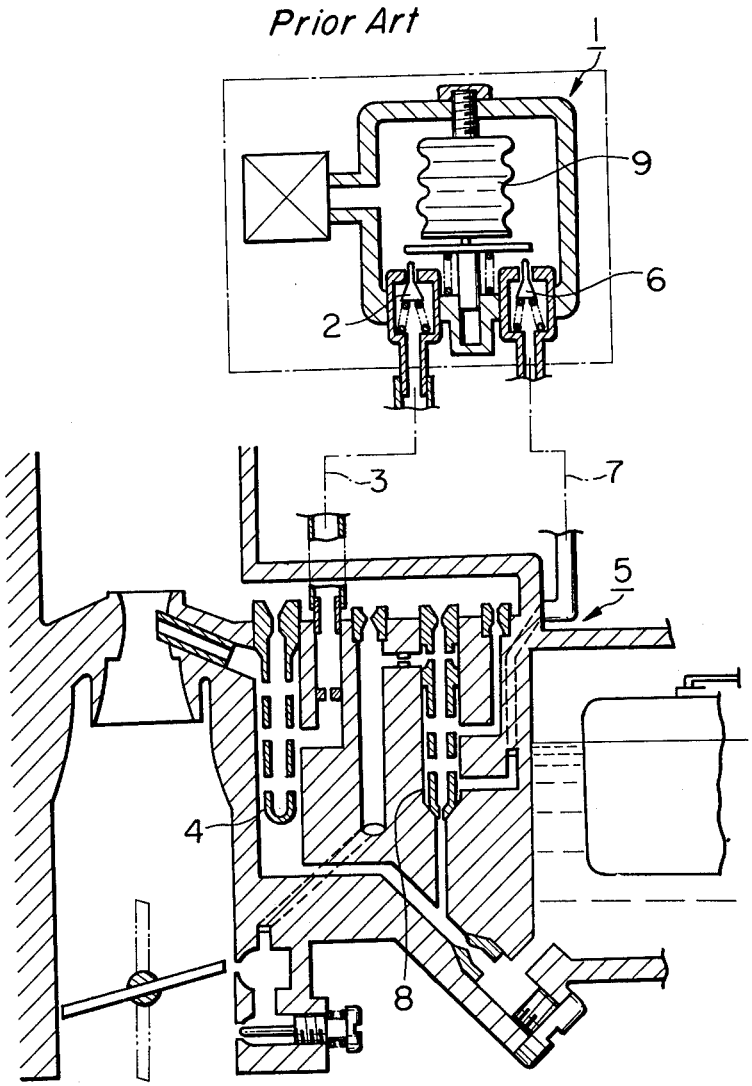
Fig. 1 Prior Art
FIG. 1 is a schematic cross sectional view of a conventional altitude correction device.

Referring to FIG. 1 of the drawings, there is shown a conventional altitude correction device as per the introduction of the present specification. As shown in FIG. 1, the conventional altitude correction device, generally designated by the reference numeral 1, comprises a first control valve 2 operable to control a first supplementary air bleed 3 communicating with a fuel passage 4 of a main system or high speed circuit of a carburetor 5, a second control valve 6 operable to control a second supplementary air bleed 7 communicating with a fuel passage 8 of an idle system or low speed circuit of the carburetor 5, and an atmospheric pressure responsive deformable bellows 9 which extends and compresses in response to changes in the altitude to cause the control valves 2 and 6 operate to control the amount of supplementary air admitting into the supplementary air bleeds 3 and 7. The altitude correction device 1 has a disadvantage that the bellows 9 extends and compresses in response to vibrations acting on the device 1 to cause the control valves to operate to render it impossible to correct decreases in an air-fuel ratio due to increases in the altitude.

Figure 2:
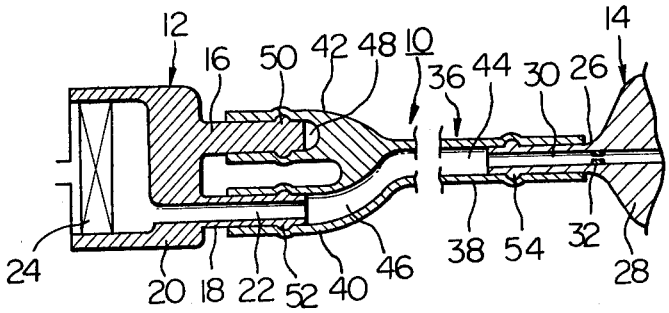
FIGS. 2 and 3 are schematic cross sectional views of a first preferred embodiment of an altitude correction device according to the invention.
Figure 3:
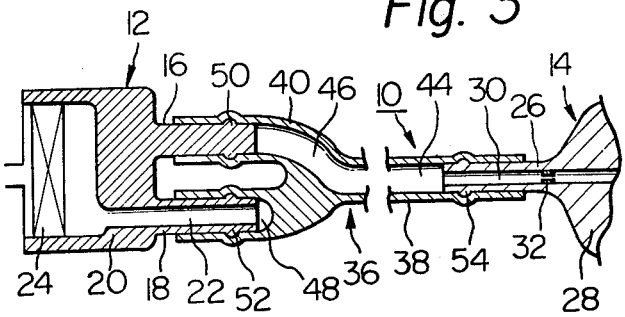

Referring to FIGS. 2 and 3 of the drawings, there is shown an altitude correction device according to the invention, generally designated by the reference numeral 10, and an air cleaner 12 and a carburetor 14 of an internal combustion engine (not shown) which are combined with the altitude correction device 10.

The air cleaner 12 is formed thereon with first and second connections 16 and 18 projecting from an external surface of the air cleaner body or housing 20 and extending in parallel to each other. The first connector 16 is solid and forms a blind plug, while the second connector 18 is formed therethrough with an axial bore or passage 22 communicating at an end with the interior of the air cleaner body 20 in which interior an air cleaner element 24 is located. The diameters or cross sectional areas of the connectors 16 and 18 are equal to each other. An air cleaner may be employed which is other than the air cleaner 12 of the engine.

The carburetor 14 may be the carburetor shown in FIG. 1 and is formed with a connector 26 projecting from an external surface of the carburetor body 28. The connector 26 is formed therethrough with an axial bore or passage or supplementary air bleed 30 communicating at an end with a fuel passage (not shown) of the carburetor 14. The supplementary air bleed 30 is formed therein with an air bleed jet 32.

A supplementary air bleed control connection or coupling 36 is provided to manually provide and obstruct field communication between the passages 22 and 30 to open and close the supplementary air bleed 30 to the atmosphere. The coupling 36 is made of a pliable and elastic material such as rubber and comprises a singular section 38 and first and second branch sections 40 and 42 forked from the singular section 38 and extending in parallel to each other. The singular section 38 and the first branch section 40 are formed therethrough respectively with axial bores or passages 44 and 46 which are aligned with each other. The second branch section 42 has a base end portion which is solid and an open free end portion which is formed therethrough with an axial bore 48 to form a cap. The inside diameters or cross sectional areas of the bores 46 and 48 are equal to each other and are approximately equal to the diameters or cross sectional areas of the connectors 16 and 18.

The sections 40, 42 and 38 of the coupling 36 are manually connected with and disconnected or removed from the connectors 16, 18 and 26 by hand operation of the operator (not shown) to change over the connection of the connectors 16 and 18 to the branch sections 40 and 42 in accordance with changes in the altitude of the engine running land. The passage section 38 is pulled on the connector 26 only irrespectively of the altitude of the engine running land. The passage and cap branch sections 40 and 42 are manually pulled respectively on the passage and solid or plug connectors 16 and 18 by the operator as shown in FIG. 2 when the engine is running on a relatively high land. At this time, supplementary air is admitted into the fuel passage of the carburetor 14 by way of the passages 22, 44, 46 and 30 to prevent enrichment of an air-fuel mixture, provided by the carburetor 14, due to a decrease in atmospheric pressure so that the carburetor 14 provides an air-fuel mixture having a set or desired air-fuel ratio. The passage and cap branch sections 40 and 42 are manually pulled respectively on the plug and passage connectors 18 and 16 by the operator as shown in FIG. 3 when the engine is running on a relatively low land. At this time, the supplementary air bleed 30 is isolated from the ambient atmosphere by the cap branch section 42 to prevent an unnecessary increase in the air-fuel ratio of the air-fuel mixture provided by the carburetor 14.

The connectors 16, 18 and 26 are formed thereon at positions adjacent to their free ends with annular projections 50, 52 and 54 which are lateral to the axes of the connectors 16, 18 and 26 and have diameters or cross sectional areas larger than those of the bores 46, 48 and 44 of the sections 40, 42 and 38 of the coupling 36, respectively. The annular projections 50, 52 and 54 provide air tight seals between the connectors 16, 18 and 26 and the internal surfaces of the bores 46, 48 and 44 of the coupling 36 and/or prevent the coupling 36 from being removed from or moved along the connectors 16, 18 and 26 by a force smaller than a force of the operator for connecting or removing the coupling 36.

The blind or cap branch section 42 of the coupling 36 can be dispensed with so that the connectors 16 and 18 are not covered by the coupling 36 when the correction of enrichment of the air-fuel mixture is effected and is unnecessary, respectively.

Figure 4:
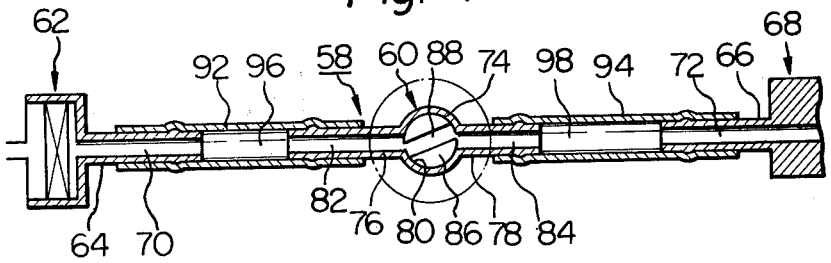
FIG. 4 is a schematic cross sectional view of a second preferred embodiment of an altitude correction device according to the invention.
Figure 5:
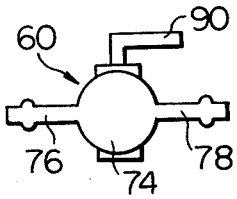
FIG. 5 is a schematic side view of a control valve forming part of the altitude correction device shown in FIG. 4.
Figure 6:
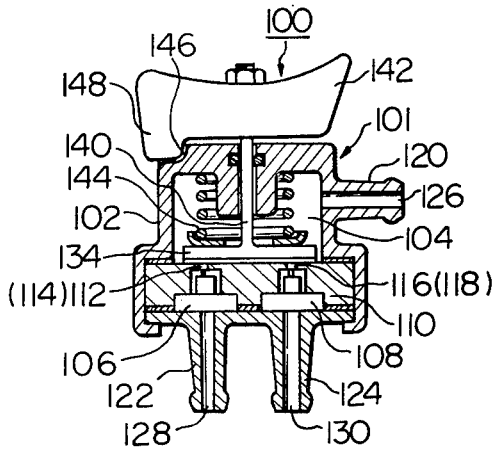
FIG. 6 is a schematic cross sectional view of a third preferred embodiment of an altitude correction device according to the invention.

Referring to FIGS. 4 and 5 of the drawings, there is a second preferred embodiment of an altitude correction device according to the invention. As shown in FIG. 4, the altitude correction device, generally designated by the reference numeral 58, is mainly different from the altitude correction device 10 shown in FIGS. 2 and 3 in that a manually operated supplementary air bleed control valve or cock 60 is provided in place of the coupling 36. For this purpose, an air cleaner 62 combined with the altitude correction device 58 is formed thereon with only a connection 64 which functionally corresponds to the connection 18 of the air cleaner 12 of FIGS. 2 and 3.

The control valve 60 is disposed between the connector 64 and a connector 66 formed on a carburetor 68 and functionally corresponding to the connector 26 of the carburetor 14 of FIGS. 2 and 3, and selectively provides and obstructs fluid communication between axial bores or passages 70 and 72 formed respectively through the connectors 64 and 66 to open and close the supplementary air bleed 72 to the atmosphere. The control valve 60 comprises a valve body or housing 74 and two connectors 76 and 78 projecting therefrom, for example, in opposite directions as shown in the drawing. The valve body 74 is formed therein with a valve chamber 80 of a cylindrical or spherical shape, while the connectors 76 and 78 are formed therethrough with axial bores or passages 82 and 84 opening into the valve chamber 80. A rotary valve head or member 86 is slidably and rotatably fitted in the valve chamber 80 and is formed therethrough with a passage 88 which can be in alignment with the passages 82 and 84. The control valve 60 is operated by the operator through a hand grip 90 fixedly connected to the valve head 86.

The couplings 92 and 94 which may be of a pliable and elastic material such as rubber are provided to connect the connectors 76 and 78 of the control valve 86 to the connectors 64 and 66 and are formed therethrough with axial bores or passages 96 and 98, respectively. The coupling 92 is pulled at its opposite ends on the connectors 64 and 76, while the coupling 94 is pulled at its opposite ends on the connectors 66 and 78.

The control valve 60 is moved by the operator into a first position in which the passage 88 of the valve head 86 is in alignment with the passages 82 and 84 so that supplementary air is admitted into the supplementary air bleed 72 to compensate a reduction in atmospheric pressure when the engine is running on a relatively high land. The control valve 60 is moved into a second position in which the valve head 86 blocks fluid communication between the passages 82 and 84 to prevent supplementary air from being admitted into the supplementary air bleed 72 when the engine is running on a relatively low land.

The altitude correction devices 10 and 58 thus far described may be applied to a carburetor including a plurality of supplementary air bleeds connected to fuel passages of a plurality of air-fuel mixture forming systems or circuits such as main and idle systems or high and low speed circuits. In this instance, one supplementary air bleed control coupling 36 or one supplementary air bleed control valve 60 is provided for each of the supplementary air bleeds.

Referring to FIGS. 6 to 9 of the drawings, there is a third preferred embodiment of an altitude correction device according to the invention. The altitude correction device, generally designated by the reference numeral 100, is combined with an air cleaner (not shown) such as an engine air cleaner. The air cleaner is formed thereon with a connection projecting from an external surface of the air cleaner body. The connector is formed therethrough with an axial bore or passage communicating at one end with the interior of the air cleaner. The altitude correction device 100 is also combined with a two barrel and two stage carburetor (not shown) which includes primary and secondary sides having primary and secondary side main systems or high speed circuits and primary and secondary side idle systems or low speed circuits and is operated in such a manner that only the primary side provides an air-fuel mixture during engine normal operations other than high speed and high load running and both the primary and secondary sides provide air fuel mixtures during high speed and high load running of the engine. The carburetor is formed thereon with first and second connectors (not shown) projecting from an external surface of the carburetor body. The first connector is formed therethrough with a first axial passage or supplementary air bleed communicating at one end with a fuel passage of a primary side main system or high speed circuit of the carburetor. The second connector is formed therethrough with a second axial passage or supplementary air bleed communicating at one end with a fuel passage of a primary side idle system or low speed circuit of the carburetor.

The altitude correction device 100 comprises a control valve 101 for manually or selectively opening and closing the supplementary air bleeds of the carburetor to the atmosphere in accordance with changes in the altitude of the engine running land and comprising a housing 102 which is formed therein with a main air or valve chamber 104 and first and second auxiliary air chambers 106 and 108 separated from the chamber 104 by a partition member 110 through which jets 112, 114, 116 and 118 are formed. The chamber 104 communicates with the chamber 106 through the jets 112 and 114 and with the chamber 108 through the jets 116 and 118. The housing 102 is also formed thereon with three connectors 120, 122 and 124 projecting from its external surface. The connector 120 is formed therethrough with an axial bore or passage 126 communicating with the chamber 104, while the connectors 122 and 124 are formed therethrough with axial bores or passages 128 and 130 communicating respectively with the chambers 106 and 108. The connector 120 is connected to the connector of the air cleaner through a coupling (not shown) such as the coupling 92 or 94 of FIG. 4, while the connectors 122 and 124 are connected respectively with the first and second connectors of the carburetor through couplings (not shown) such as the coupling 92 or 94 of FIG. 4. The jets 112, 114, 116 and 118 are arranged in a first group of jets 112 and 114 adjacent to each other and a second groups of jets 116 and 118 adjacent to each other. The first and second groups are arranged apart from each other, for example, symmetrically with respect to the center of the partition member 110, as shown FIGS. 7 to 9.

Figure 7:
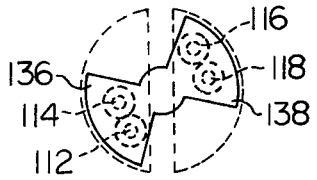
FIGS. 7 to 9 are schematic views showing various positions of a control valve, forming part of the altitude correction device shown in FIG. 6, varying with changes in the altitude.
Figure 8:
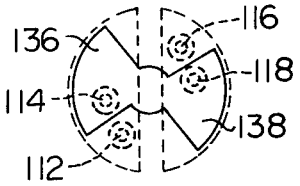
Figure 9:
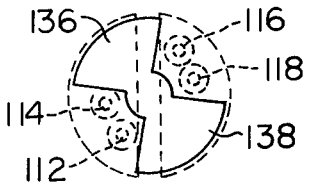

The control valve 101 is manually operated to open and close the passages 128 and 130 and accordingly the supplementary air bleeds of the carburetor to the atmosphere and comprises a valve head 134 slidably and rotatably located on the partition member 110 in the valve chamber 104 to open and close the jets 112, 114, 116 and 118 and to provide an air tight seal for each jet when closes. The valve head 134 is, for example, in the form of first and second sectors 136 and 138 connected at a central portion to each other and located symmetrically with respect to the center of the partition member 110 and employed respectively for the first and second groups of jets 112 and 114 and jets 116 and 118, as shown in FIGS. 7 to 9. A valve rod 140 extends from the valve head 134 and externally of the valve chamber 104 and is fixedly connected at its free end to a knob 142 manually rotatably located on the housing 102. The knob 142 has a first position in which the first and second sectors 136 and 138 close both the jets 112 and 114 of the first group and both the jets 116 and 118 of the second group as shown in FIG. 7, respectively, a second position in which the first sector 136 opens the jet 112 and closes the jet 114 of the first group and the second sector 138 opens the jet 116 and closes the jet 118 of the second group as shown in FIG. 8, and a third position in which the first and second sectors 136 and 138 open both the jets 112 and 114 of the first group and both the jets 116 and 118 of the second group as shown in FIG. 9. The first, second and third positions are marked respectively by, for example, 0, 1,500 m and 3,000 m to indicate the altitude. A spring 144 is located in the valve chamber 104 and presses the valve head 134 against the partition member 110. The housing 102 is formed therein adjacent to the knob 142 with first, second and third recesses or grooves 146 only one of which is shown and which correspond respectively to the first, second and third positions of the knob 142. The knob 142 has a detent or pawl 148 projecting therefrom toward the housing 102 and alternatively engaging the first, second and third recesses 146 of the housing 102 to hold the knob 142 in the first, second and third positions, respectively. The knob 142 is manually movable upwardly in the drawing by the operator to disengage the detent 148 from one of the recesses 146 and then to engage the detent 148 with the other recess 146 so that the position of the knob 142 is changed over between the first, second and third positions.

The altitude correction device 100 thus far described is operated as follows:

When the engine is running at a normal or low altitude which is equal to or near the sea level, the knob 142 is positioned in the first position in which the detent 148 engages the first recess 146 so that the control valve 101 closes all the jets 112, 114, 116 and 118 as shown in FIG. 7 to prevent supplementary air from being admitted into the passages 128 and 130.

When the engine is running at a mediate altitude, for example, 1,500 m above the sea level, the knob 142 is positioned in the second position in which the detent 148 engages the second recess 146 so that the control valve 101 opens the jets 112 and 116 and closes the jets 114 and 118 as shown in FIG. 8 to admit a relatively small quantity of supplementary air into the passages 128 and 130 to prevent enrichment of the air-fuel mixture, provided by the carburetor, due to an increase in the altitude.

When the engine is running at a high altitude, for example, 3,000 m above the sea level, the knob 142 is positioned in the third position in which the detent 148 engages the third recess 146 so that the control valve 101 opens all the jets 112, 114, 116 and 118 as shown in FIG. 9 to admit a relatively large quantity of supplementary air into the passages 128 and 130 to prevent a decrease in the air-fuel ratio to below the set air-fuel ratio.

The carburetor may be formed thereon with third and fourth connectors, such as the first and second connectors, which are formed therethrough respectively with axial fores or passages or supplementary air bleeds communicating with fuel passages of secondary side main and idle systems or high and low speed circuits of the carburetor. The device 100 may comprise a control valve, similar to the control valve 101, which includes three connectors connected to an additional connector of the air cleaner and the third and fourth connectors of the carburetor.

Figure 10:
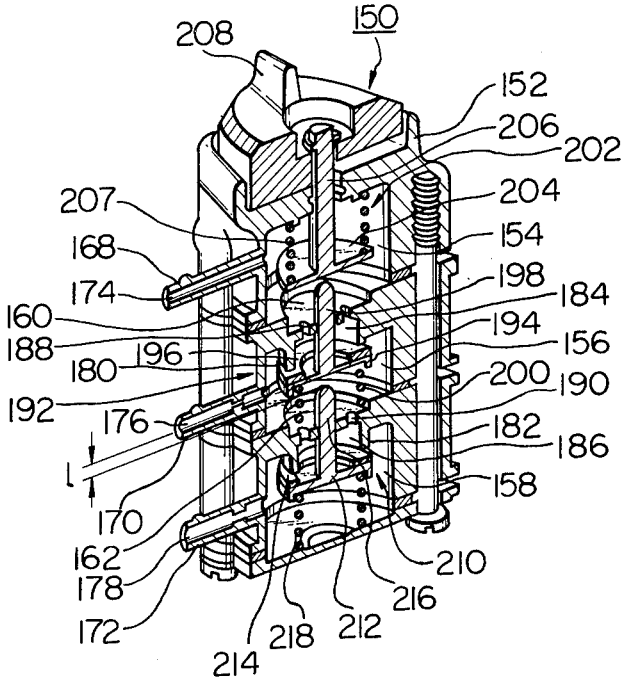
FIG. 10 is a schematic cross sectional view of a fourth preferred embodiment of an altitude correction device according to the invention.

Referring to FIG. 10 of the drawings, there is shown a fourth preferred embodiment of an altitude correction device according to the invention. As shown in FIG. 10, the altitude correction device, generally designated by the reference numeral 150, comprises a twin control valve assembly for manually and stepwise opening and closing a supplementary air bleed of a carburetor to the atmosphere and comprising a housing 152 having first, second and third chambers 154, 156 and 158, a first partition member 160 separating the chambers 154 and 156 from each other and a second partition member 162 separating the chambers 156 and 158 from each other. The housing 152 is formed thereon with first, second and third connectors 168, 170 and 172 projecting from an external surface thereof. The connectors 168, 170 and 172 are formed therethrough with axial bores or passages 174, 176 and 178 communicating respectively with the chambers 154, 156 and 158. The passage 174 communicates with an air cleaner (not shown) such as an engine air cleaner in a manner as described previously with respect to the prior embodiments. The passages 176 and 178 communicate with a supplementary air bleed (not shown) communicating with a fuel passage of a main or idle system of a carburetor (not shown) through suitable means such as a bifurcate coupling in a manner as described hereinbefore.

First and second annular valve seats 180 and 182 project respectively from the partition members 160 and 162 into the chambers 156 and 158 and define fourth and fifth chambers 184 and 186 in the chambers 156 and 158, respectively. The chambers 184 and 186 communicate respectively with the chambers 154 and 156 through apertures 188 and 190 formed through the partition members 160 and 162.

A first control valve 192 is provided to manually open and close the passage 176 to the atmosphere and comprises a valve head 194 located in the chamber 156 and movable to seat on and unseat from the annular valve seat 180 to close and open the chamber 184 to the chamber 156. The valve head 194 may have a sealing member 196 on its upper surface which directly engages the valve seat 180 to provide an air tight seal between the valve seat and head 180 and 194. A valve stem 198 extends from the valve head 194 into the chamber 154 through the chamber 184. A compression spring 200 is located in the chamber 156 and presses the valve head 194 against the valve seat 180.

An actuator 202 is provided to operate the control valve 192 and comprises an actuating head 204 located in the chamber 154 and movable to engage a free end of the valve stem 198. An actuating rod 206 extends from the actuating head 204 and externally of the housing 152. A compression spring 207 is located in the chamber 154 and urges the actuating head 204 toward the free end of the valve stem 198. A knob 208 is slidably and rotatably mounted on the housing 152 and is fixedly connected to the actuating rod 206.

A second control valve 210 is provided to manually open and close the passage 178 to the atmosphere and comprises a valve head 212 located in the chamber 158 and movable to seat on and unseat from the annular valve seat 182 to close and open the chamber 186 to the chamber 158. The valve head 212 may have a sealing member 214 on its upper surface which directly engages the valve seat 182 to provide an air tight seal between the valve seat and head 182 and 212. A valve stem 216 extends from the valve head 212 into the chamber 156 through the chamber 186. A compression spring 218 is located in the chamber 158 and presses the valve head 212 against the valve seat 182. The valve head 194 is engageable with a free end of the valve stem 216.

Figure 11:
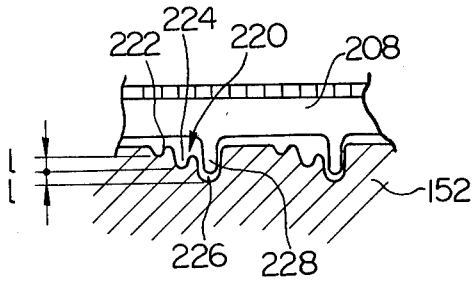
FIG. 11 is a schematic cross sectional view showing the relationship between a cam of a housing and a cam follower of a knob forming part of the altitude correction device shown in FIG. 10.

The housing 152 is formed therein adjacent to the knob 208 with a cam 220 comprising first, second and third recesses or grooves 222, 224 and 226 for low and first and second high lands, respectively, as shown in FIG. 11 of the drawings. The level of the groove 222 is higher than that of the groove 224 by a predetermined value *l*, and the level of the groove 224 is similarly higher than that of the groove 226 by the predetermined value *l*. The recesses 222, 224, 226 are steps which form part of an arcuate or circular inclined recess (not shown) formed in the housing 152 and are angularly spaced apart from each other. FIG. 11 shows three steps gathered together in one place for illustration. It is desirable to form such three inclined arcuate or circular recesses to hold the knob 208 horizontally. The knob 208 has a cam follower or detent 228 projecting therefrom toward the housing 152 and engaging the cam 220. The cam follower 228 alternatively engages the grooves 222, 224 and 226 by rotating the knob 208 predetermined angles. The knob 208 has first, second and third positions in which the cam follower 228 engages the grooves 222, 224 and 226, respectively. When the knob 208 is in the first position, the valve heads 194 and 212 are seated on the valve seats 180 and 182 by the springs 200 and 218, respectively. At this time, the valve head 194 is spaced apart from the free end of the valve stem 216 by the predetermined value or distance *l* as shown in FIG. 10, while the actuating head 204 is spaced apart from the free end of the valve stem 198 by a value or distance below the predetermined value *l*.

The altitude correction device 150 thus far described is operated as follows:

When the altitude is equal to or near the sea level, the knob 208 is positioned by the operator in the first position in which the pawl 228 engages the first recess 222 so that supplementary air is prevented from being admitted into the chambers 156 and 158.

When the altitude increases to a certain value, for example, 1,500 m above the sea level, the knob 208 is positioned by the operator in the second position in which the pawl 228 engages the second recess 224 so that the knob 208 and the actuator 202 are forced the predetermined value *l* downwardly by the spring 207 to move the first control valve 192 into a position in which the valve head 194 unseats from the valve seat 180. A relatively small quantity of supplementary air is admitted into the supplementary air bleed of the carburetor through the chambers 184 and 156 and the passage 176 to prevent enrichment of the air-fuel mixture due to an increase in the altitude. At this time, the valve head 194 approaches the free end of the valve stem 216 of the second control valve 210.

When the altitude furthermore increases to a certain value, for example, 3,000 m above the sea level, the knob 208 is positioned by the operator in the third position in which the pawl 228 engages the third recess 226 so that the knob 208 and accordingly the actuator 202 and the first control valve 192 are forced the predetermined value *l* downwardly from the second position by the spring 207 and the first control valve 192 engages the second control valve 210 to move it into a position in which the valve head 212 unseats from the valve seat 182. Thus, a relatively large quantity of supplementary air is admitted into the supplementary air bleed of the carburetor through the chambers 184, 156, 186 and 158 and the passages 176 and 178 to prevent a decrease in the air-fuel ratio owing to a further increase in the altitude.

It will be appreciated that the invention provides an altitude correction device comprising a coupling or control valve which manually controls or selects the amount of supplementary air, fed into a supplementary air bleed communicating with a fuel passage of a carburetor, in accordance with changes in the altitude by merely switching over the connection of the coupling or by rotating a knob of the control valve into predetermined positions in accordance with changes in the altitude so that the amount of supplementary air fed into the supplementary air bleed is prevented from being affected by vibrations, the construction of the device is simplified to reduce troubles occurring in the device, and the costs of production and maintenance of the device are reduced.

What is claimed is:

1. Fuel supply apparatus and means to manually control the supply of supplemented air into a fuel passage thereof, comprising a hollow coupling member, a housing mounting a filter element and including a passage connector having an open axial passage and a solid connector, each adapted to optionally receive said hollow coupling member, one end of said hollow coupling member being mounted on one of said connectors, and the other end thereof being operatively connected to supply air to said fuel passage.

2. Fuel supply apparatus and means to manually control the supply of supplemented air into a fuel passage thereof as claimed in claim 1, in which said hollow coupling member has a branch diverged therefrom, and having a base portion which is solid and an open free end portion which is formed therein with an axial bore, said open free end portion of said branch being mounted on said solid connector of said housing when it is necessary to admit supplementary air into said fuel passage and being mounted on said passage connector of said housing when it is unnecessary to admit supplementary air into said fuel passage.

3. Fuel supply apparatus and means to manually control the supply of supplemented air into a fuel passage thereof as claimed in claim 1, in which said hollow coupling member is made of a pliable and elastic material.

* * * * *